US010448725B2

(12) United States Patent
Weigel

(10) Patent No.: US 10,448,725 B2
(45) Date of Patent: Oct. 22, 2019

(54) COSMETIC WIPER WITH WIPER ARMS

(71) Applicant: GEKA GmbH, Bechhofen (DE)

(72) Inventor: Friedrich Weigel, Wittelshofen (DE)

(73) Assignee: GEKA GmbH, Bechhofen (DE)

( * ) Notice: Subject to any disclaimer, the term of this patent is extended or adjusted under 35 U.S.C. 154(b) by 324 days.

(21) Appl. No.: 15/502,340

(22) PCT Filed: Aug. 7, 2015

(86) PCT No.: PCT/EP2015/068304

§ 371 (c)(1),
(2) Date: Jul. 5, 2017

(87) PCT Pub. No.: WO2016/020539

PCT Pub. Date: Feb. 11, 2016

(65) Prior Publication Data

US 2017/0303660 A1 Oct. 26, 2017

(30) Foreign Application Priority Data

Aug. 7, 2014 (DE) ..... 20 2014 103 677 U

(51) Int. Cl.
*A45D 34/04* (2006.01)
*A45D 40/26* (2006.01)

(52) U.S. Cl.
CPC ..... *A45D 34/046* (2013.01); *A45D 40/267* (2013.01)

(58) Field of Classification Search
CPC .. A45D 34/046; A45D 34/047; A45D 40/267; A45D 40/268
USPC ..... 401/121–122
See application file for complete search history.

(56) References Cited

U.S. PATENT DOCUMENTS 3,372,424 A * 3/1968 Kellett ..... A45D 34/046 15/257.05
4,390,298 A * 6/1983 Carluccio ..... A45D 34/046 15/257.05
5,873,669 A 2/1999 Poore et al.
5,875,791 A * 3/1999 Sheffler ..... A45D 40/267 132/218
6,238,116 B1 * 5/2001 Smith ..... A45D 34/046 401/122
6,502,584 B1 * 1/2003 Fordham ..... A45D 34/046 132/218
6,974,271 B2 * 12/2005 Wainer ..... A45D 40/268 401/121
7,182,535 B2 * 2/2007 Lim ..... A45D 40/267 401/122

(Continued)

FOREIGN PATENT DOCUMENTS

DE 202011051676 1/2013

*Primary Examiner* — David P Angwin
*Assistant Examiner* — Bradley S Oliver

(57) ABSTRACT

A wiper for wiping an associated cosmetic applicator, wherein the wiper has a retaining portion for securing the wiper on a cosmetic supply container, and also has at least two wiper arms, which are arranged on the container and subject the associated cosmetic applicator to wiping action. Each of the at least two wiper arms is arranged in an elastically movable manner on the retaining portion and has a shaft portion and a ring portion, which forms a wiper lip or a part thereof, wherein the extent of the ring portion in the circumferential direction is greater than the extent of the shaft portion in the circumferential direction.

17 Claims, 5 Drawing Sheets

(56) References Cited

U.S. PATENT DOCUMENTS

| | | | | |
|---|---|---|---|---|
| 8,221,013 | B2 * | 7/2012 | Salciarini | A45D 40/267<br>132/218 |
| 8,783,987 | B2 * | 7/2014 | Kulik | A45D 34/046<br>401/122 |
| 8,801,310 | B2 * | 8/2014 | Kulik | A45D 34/046<br>401/122 |
| 9,642,442 | B2 * | 5/2017 | Pires | A45D 34/046 |
| 2005/0095052 | A1 | 5/2005 | Wainer | |
| 2010/0129132 | A1 * | 5/2010 | Pires | A45D 40/267<br>401/122 |
| 2012/0063835 | A1 * | 3/2012 | Inoue | A45D 34/046<br>401/126 |
| 2013/0101337 | A1 * | 4/2013 | Kulik | A45D 40/267<br>D40/267 |
| 2014/0369736 | A1 * | 12/2014 | von Jan | A45D 40/267<br>401/122 |
| 2017/0311699 | A1 * | 11/2017 | Manici | A45D 40/267 |
| 2018/0168320 | A1 * | 6/2018 | Chung | A45D 40/267 |

* cited by examiner

COSMETIC WIPER WITH WIPER ARMS

FIELD OF THE INVENTION

The invention is directed to a wiper, in particular to a wiper for wiping off a cosmetics applicator that can be associated with it, or is associated with it in the case of the wiper being used in a cosmetics storage container, wherein the wiper has a retaining portion for fixing the wiper to a cosmetics storage container and at least two wiper arms that are disposed on the retaining portion and exert a wiping action on the associated cosmetics applicator.

BACKGROUND OF THE INVENTION

Such a wiper serves for wiping off excess cosmetic mass from an applicator that is dipped into a cosmetic mass stored in a cosmetics storage container and is then withdrawn from the cosmetics storage container through the wiper, in order to apply a certain amount of the cosmetic, preferably without any dripping, with the cosmetics applicator then loaded with cosmetic mass. In particular, the invention relates to a wiper for lip gloss mass or mascara mass applicators. Generally, such a cosmetics applicator consists of an actual applicator portion, which is attached to its one end and frequently configured as a bristle covering, and an applicator handling means attached to its opposite end, in which the applicator handle is frequently configured as a screw cap at the same time. The applicator portion and the applicator handling means are connected to an applicator stem which, if disposed in an applicator container or cosmetics storage container containing the supply of cosmetic mass, is positioned so as to be movable in the center of the wiper inserted into the mouth of the applicator container or cosmetics storage container.

Various designs of applicators have become known in the prior art. Such applicators are most frequently configured as sleeves or tubular bodies that taper at one end in the manner of a truncated cone, in the broadest sense. The portion configured like a truncated cone forms a wiper lip which extends peripherally in the circumferential direction, is most frequently closed in itself or subdivided into closely adjacent circle segments.

When dimensioning such a wiper lip, considerable attention has to be paid with regard to the diameter of the stem with which the actual applicator portion, which predominantly consists of a bristle covering, is connected to the applicator handle.

A conflict of objectives is often the result especially if applicators with a bristle covering are used. If the clear internal diameter of the wiper lip of such a wiper is dimensioned to be comparatively large, the wiper does not put up any excessive resistance to the withdrawal of the applicator, but leaves a lot of cosmetic mass in the bristle covering. Once the clear diameter of the area enclosed by the wiper lip is made considerably smaller than the diameter of the applicator stem, the actual applicator portion is wiped off to a considerably greater extent. However, the resistance that has to be overcome when the applicator is withdrawn is increased significantly at the same time.

In many cases, this conflict of objectives leads to the necessity, with regard to the design of the applicator, of having to maintain a certain diameter ratio between the applicator stem and the core of the applicator carrying the bristles, which limits the design options.

US 2005/0095052 A1 already discloses a wiper comprising a solid retaining portion to be fixed in a mouth opening of an applicator container, with a flexible wiper arm that is attached thereto by molding and forms a circle segment. The flexible wiper arm can be moved in such a way by means of an operating means that the distal diameter of the wiper inside the applicator container can be varied thereby. This is disadvantageous in that the flexible wiper arm has to be operated from the outside.

SUMMARY OF THE INVENTION

The invention is based on the object of creating a solution that provides a wiper in which the intensity of wiping and the resistance that the wiper puts up against the withdrawal of the applicator and the actual applicator portion are favorably balanced and, in particular, in which an operation from the outside is not necessary for achieving a change of the distal diameter of the wiper inside the applicator container.

In a wiper of the type referred to in detail in the introduction, this object is achieved, according to the invention, in that each of the at least two wiper arms is disposed on the retaining portion in an elastically movable manner and has a stem portion and a ring portion, which forms a wiper lip or a part thereof, wherein the extent of the ring portion in the circumferential direction is greater than the extent of the stem portion in the circumferential direction.

The above object is also achieved by a cosmetics unit with a cosmetics storage container, an applicator, a closure cap and a wiper, which is mounted in the neck or the removal opening of the cosmetics storage container, for wiping off cosmetic mass from the wiper.

Therefore, the above object is achieved by a wiper for wiping off the cosmetics applicator with a retaining portion for fixing the wiper to a cosmetics storage container. In this case, the wiper has at least two wiper arms exerting a wiping action. Each of these at least two wiper arms in turn consists of a stem portion and a ring portion. In this case, the ring portion is the portion constituting the wiper lip or a part thereof, i.e. that exerts at least the major or even at least substantially complete wiping effect. What is important is that the extent of the ring portion in the circumferential direction is greater than the extent of the associated stem portion in the circumferential direction. In this case, it is not intended by the invention that the extent of the ring portion in the circumferential direction is greater than the extent of the associated stem portion in the circumferential direction only to an inconsiderable extent, by a small amount in the range of a fraction of a millimeter. Rather, it is important that the extent of the stem portion in the circumferential direction is significantly smaller or less than the extent of the associated ring portion molded onto it. The smaller the area of the stem portion extending in the circumferential direction and thus the extent over which the stem portion is molded onto the retaining portion is configured to be, the more elastic this connecting area between a respective stem portion and the retaining portion is configured to be, or the more elastic this connecting portion can be configured and adjusted to be.

In addition, this design provides the option of making the stem portion itself sufficiently elastic, so that it can be said that the respective ring portion is held at the free end of a leaf spring, which can be bent outwards in the radial direction to a more than just inconsiderable extent and is formed by the stem portion.

In this way, the characteristics of the wiper tend to become softer, i.e. the resistance it puts up against the bristle covering during withdrawal tends to become less, the bristle covering is treated gently. The danger that individual bristles buckle prematurely and are unable to straighten up again becomes significantly smaller. The wiper arms respond flexibly to cosmetics applicators of different sizes, i.e. cosmetics applicators that have different diameters in their applicator covering. Nevertheless, the wiping action is not too small, because the ring portion, due to the concave curvature which characterizes it and which its inner face has that radially faces towards the respectively associated applicator covering, still nestles up closely to the covering of the applicator and wipes it off with sufficient intensity. In this case, the extent of the wiping intensity can be controlled rather well, in a first approximation, through the smaller or greater spring elasticity of the respective stem portion onto which the respective ring portion is molded.

It is particularly beneficial if the distal end of each stem portion is capable, where the transition into the respective ring portion takes place, of being displaced outwards in an elastically reversible manner in the radial direction, under the forces arising as intended when a cosmetics applicator is wiped off, by more than just an inconsiderable extent, i.e. preferably by more than 0.8 mm, and in particular by more than 1.2 mm, which an embodiment of an invention provides. Elastically reversible is understood to mean a displacement that—except for tolerances—reverts completely when the load is relieved.

Thus, according to another embodiment of the invention, it is preferred that the stem portion is concavely curved on its inner face facing towards the longitudinal wiper axis L and preferably convexly curved on its outer face facing away from the longitudinal wiper axis L, in each case viewed in the circumferential direction.

It is particularly beneficial if the at least two wiper arms each have a ring portion which, viewed in the circumferential direction, protrudes on both sides over the molded-on stem portion and thus forms ring arms which protrude on both sides over the stem portion—and most frequently, except for a transitional rounded portion, branch off from it substantially perpendicularly, which the invention also provides.

In order to ensure optimum performance, attention must be paid that the ring arms are not only indicated and in each case possibly protrude laterally over the stem portion only slightly, by an amount of possibly only one or even the fraction of a millimeter. According to the invention, the two ring arms together, viewed in the circumferential direction, preferably constitute at least 35%, better at least 50% of the length of the ring arms. This promotes the flexibility of the ring arms, i.e. the capacity at their outermost ends to be displaced, if possible, in the radially outward direction, under a load. For the ring arms are preferably configured with such an elasticity that they are able to be resilient in a radially outward direction relative to the stem portion and the part of the ring portion directly connected with it. Thus, the invention is also characterized in that the ring arms are so elastic that they are able to be resilient in a radially outward direction relative to the stem portion.

It is beneficial if the ring arms themselves, i.e. as such, exhibit a clearly perceptible curvature in the circumferential direction. It is ideal if the ring arms form an arc that, relative to the central longitudinal wiper axis L, spans an angle of at least 12°, better of at least 20°.

In a particularly preferred embodiment of the invention, it is provided that the ring portions of all wiper arms and preferably of two diametrically opposing wiper arms form the entire wiper lip. Therefore, the wiper lip is not configured as a virtually anus-like ring closed in itself, which—so long as no rubber elastomer is used—lacks the required deformability. Instead, the wiper lip consists of several parts which are movable relative to each other and which, on their own or all together, are movable in a radially displaceable manner.

The ring portions, particularly if a total of only two of them is provided, are particularly preferably each configured in such a way that they form a pronounced arc in the circumferential direction, i.e. an arc that, relative to the central longitudinal wiper axis L, spans an angle of at least 110°, better of at least 160°.

In a very ideal case, the wiper according to the invention, in another embodiment, is characterized in that the ring portions form a circle or circular ring in the circumferential direction that is substantially closed in itself. In any case, that is the case if, directly between the ring portions, no partial sections remain free that correspond to an arc with which an angle of more than 15° and better of more than 10°.

According to an embodiment of the invention, a design is preferably selected in which a window is enclosed by two adjacent ring portions, the associated stem portions and the retaining portion. Such a window substantially improves pressure compensation and thus contributes to preventing the dreaded "blob effect". This refers to the effect that a considerable pumping action is produced when the applicator loaded with cosmetic mass is withdrawn from the cosmetics supply, which creates a significant negative pressure in the cosmetics storage container. At the instance the applicator leaves the cosmetics storage container, the internal pressure collapses abruptly, which produces said "blob" noise. This is critical in that cosmetic mass may squirt out due to the pressure surge, which is extremely undesirable due to the stain effect associated with this.

It was found to be particularly beneficial to have a projection protrude into the window, which is connected on its one side to the retaining portion and projects therefrom like a cantilever beam. Though this projection makes the free window surface area smaller, it creates an important guiding effect for the covering and, in particular in cosmetics applicators with injection-molded bristles, prevents the bristles from interacting with the window with such intensity that the danger of damage to them and/or their premature fatigue (bend recovery exhausted) looms. In another embodiment, the invention therefore provides that a projection, which is connected, preferably elastically, on its one side to the retaining portion and projects therefrom like a cantilever beam, protrudes into the window.

Ideally, the projection ends, viewed in the direction of the longitudinal wiper axis L and towards the distal end of the wiper, below the ring portions which, viewed in the circumferential direction, reach across the projection, preferably without touching it. The projection therefore closes the gap between the adjacent ring portions (viewed in the direction of the longitudinal axis) in a labyrinth-like manner.

Tests have shown that it is optimal if the projection and the window accommodating it are adapted to each other in such a way that the projection covers a maximum of 55%, better only a maximum of 45% of the window surface area (without the projection), which the invention also provides.

A preferred further alternative embodiment of the wiper according to the invention provides that the wiper has at least three wiper arms whose stem portions all have different lengths in the direction of the longitudinal wiper axis L, so that the ring portions of the wiper arms, viewed in the direction of the longitudinal wiper axis L, are held at different distances from the retaining portion.

Also in this case, it is useful if directly adjacent ring arms associated with different stem portions overlap in the direction of the longitudinal wiper axis, preferably without touching each other.

Furthermore, it advantageous also in these embodiments if a gap, which ideally increases in size in the vicinity of the retaining portion, where only the two stem portions are directly adjacent, remains free between every ring arm of a wiper arm and the stem portion of the directly adjacent longer wiper arm, wherein, preferably, a window remains free between two directly adjacent wiper arms, which is configured, in particular, in the shape of the digit "6" and/or of a mirror-inverted digit "6".

In an advantageous embodiment, the invention is finally also characterized in that the wiper is produced by means of injection molding or by means of a 3D printing method. As an alternative to injection molding, the applicator according to the invention may also be produced by 3D printing, i.e. by means of the methods that were developed for rapid prototyping.

Wipers configured in accordance with the invention are used, in particular, for wiping off mascara mass.

Further modes of operation, advantages and optional embodiments become apparent from the following description of two specific exemplary embodiments with reference to the drawings.

DETAILED DESCRIPTION OF THE INVENTION

Figure 11:
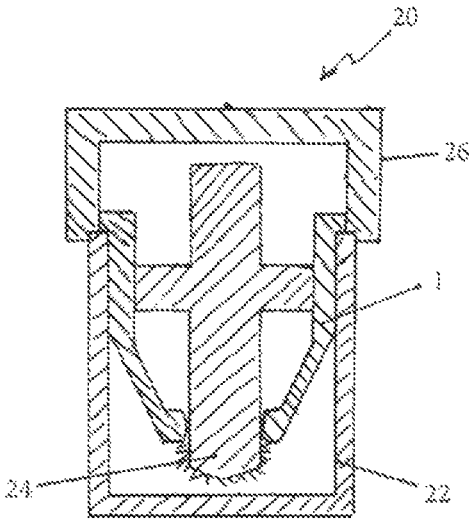
FIG. 11 shows a cosmetics unit including a wiper according to the invention in a central longitudinal section.

It has to be noted in advance that the wipers 1 according to the invention are preferably used as wipers for mascara mass. Ideally, each of the wipers 1 according to the invention forms a cosmetics unit 20 together with a cosmetics storage container 22 and a suitable cosmetics applicator 24 as well as a closure cap 26, as shown in FIG. 11. In this case, the wiper 1 according to the invention is inserted into the bottle neck or the container, removal opening in such, a way that its wiper arms protrude away from the container neck or the removal opening into the interior of the cosmetics storage container 22.

Then, it must be noted as generally valid that the term "distal" refers to the side of the wiper protruding the farthest into the interior of a cosmetics storage container in the longitudinal direction, whereas the term "proximal" refers to the side of the wiper closest in the longitudinal direction to the edge of the removal opening of the cosmetics container or cosmetics storage container.

Figure 1:
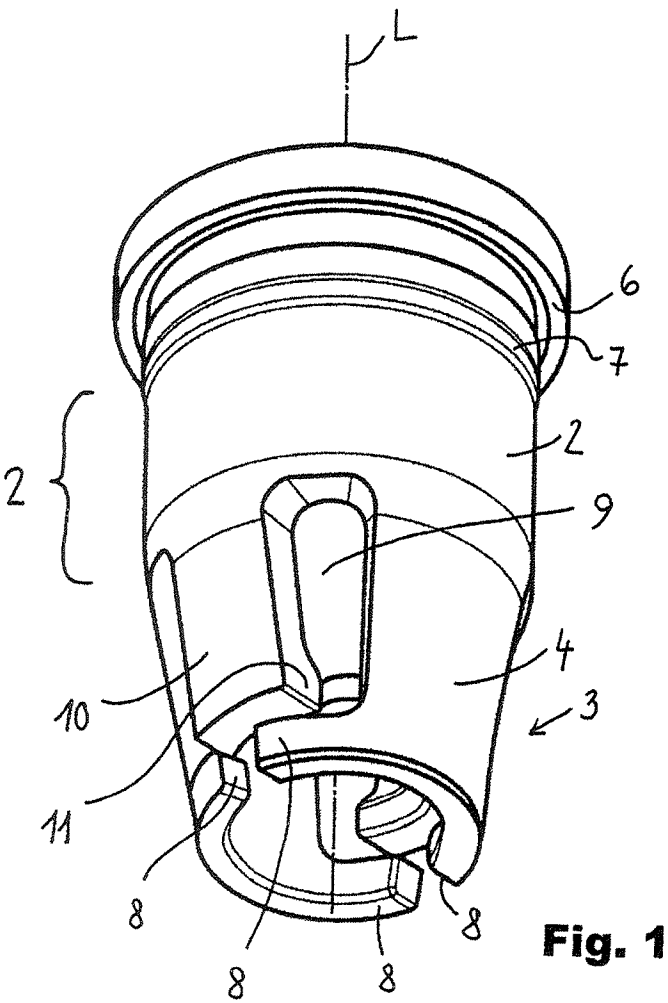
FIG. 1 shows a first exemplary embodiment of the wiper according to the invention in a perspective side view.
Figure 4:
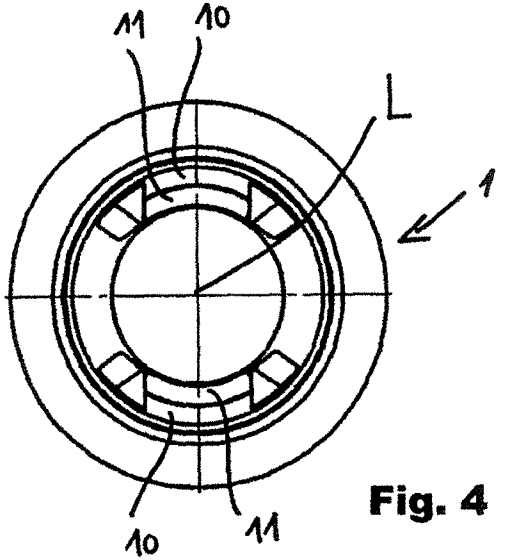
FIG. 4 shows the wiper according to FIG. 1 in a front view, viewed in the direction of the center longitudinal axis, from above.
Figure 5:
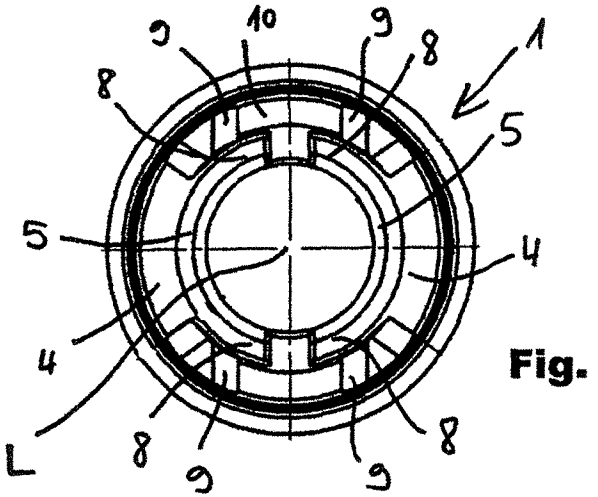
FIG. 5 shows the wiper according to FIG. 1 in a front view, viewed in the direction of the center longitudinal axis, from below.
Figure 3:
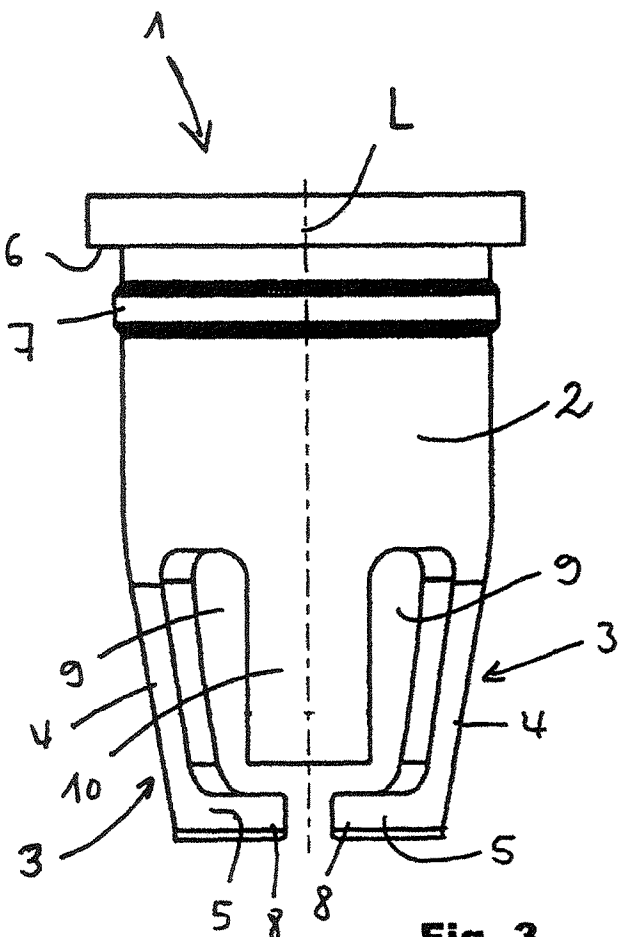
FIG. 3 shows a purely lateral view of the wiper according to FIG. 1.
Figure 7:
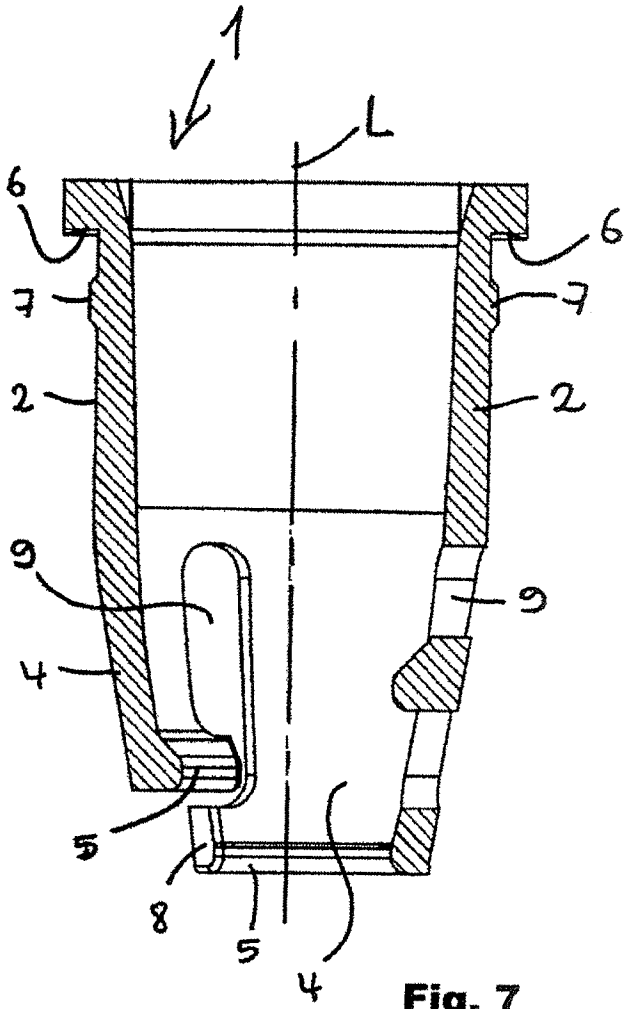
FIG. 7 shows the wiper according to FIG. 6 in a central longitudinal section.
Figure 6:
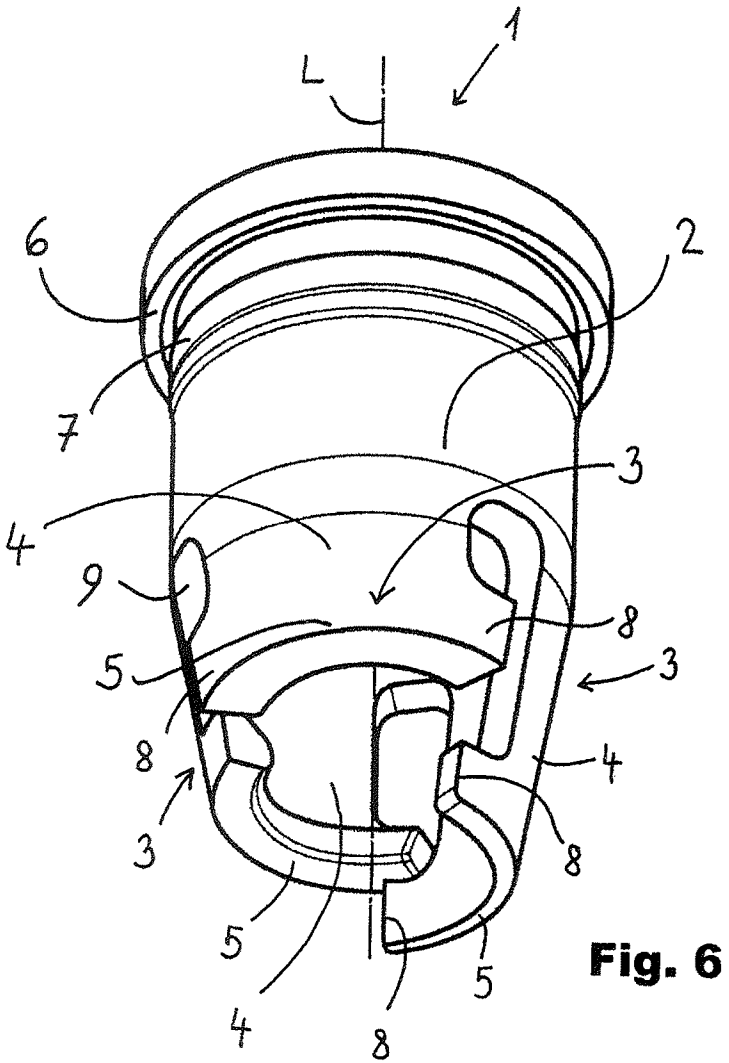
FIG. 6 shows a second exemplary embodiment of the wiper according to the invention in a perspective side view.
Figure 9:
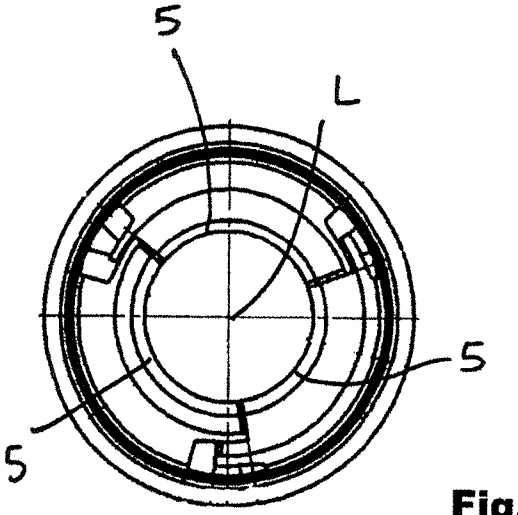
FIG. 9 shows the wiper according to FIG. 6 in a front view, viewed in the direction of the center longitudinal axis, from below.
Figure 10:
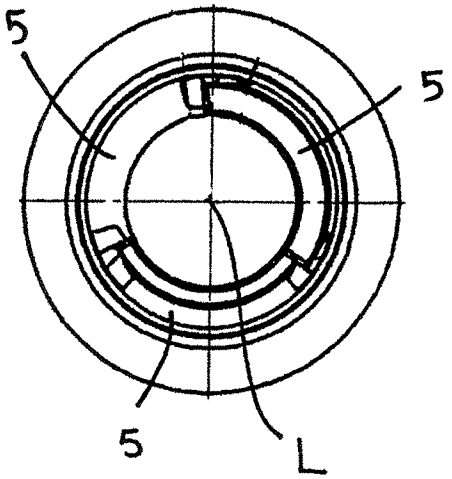
FIG. 10 shows the wiper according to FIG. 6 in a front view, viewed in the direction of the center longitudinal axis, from above.
Figure 8:
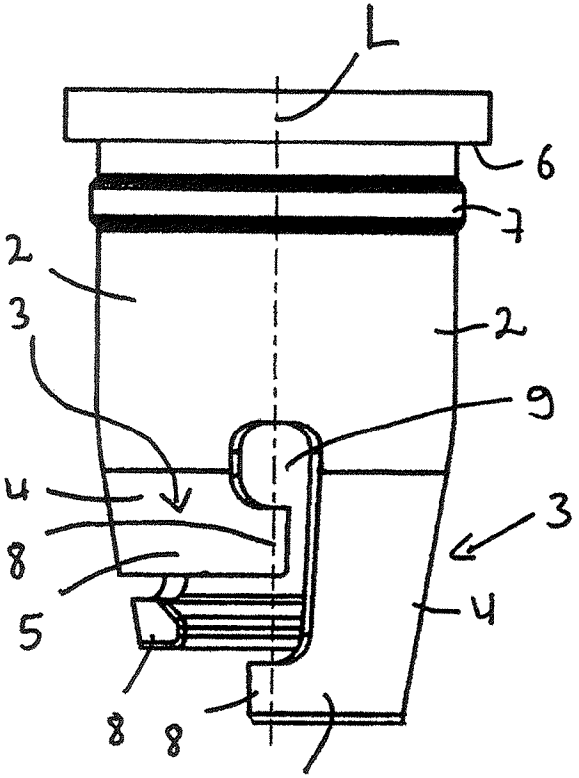
FIG. 8 shows a purely lateral view of the wiper according to FIG. 6.

FIG. 1 offers the fastest overview of a first embodiment of the wiper according to the invention.

As can be seen, the wiper 1 has a retaining portion 2 and two wiper arms 3, which can be divided into a stem portion 4 and a ring portion 5.

Generally, the retaining portion 2 has a substantially (except for tolerances) cylindrical shape and is most frequently completely closed in itself in the circumferential direction. The retaining portion 2 defines the central longitudinal wiper axis L.

In many cases, the retaining portion 2 will have a stop collar 6 with which it rests against the front face of a container opening of a cosmetics storage container in the finished state. Furthermore, the retaining portion 2 will often have a latching means that enables its positive fixation in the interior of the container opening of a cosmetics storage container, where a complementary latching means can be found. In the present exemplary embodiment, the latching means is configured as a latching bead 7.

Preferably, the wiper 1 is divided into two portions, seen in the direction of its longitudinal axis L. Said retaining portion 2 forms the first portion of the wiper 1. The second portion of the wiper 1 consists of the wiper arms 3 that are to be described in more detail later, and optionally and additionally of the projections 10, which are also to be described in more detail later. In the direction of the longitudinal wiper axis L, the first and second portions preferably have the same or approximately the same length with a difference of up to 20%.

The second portion of the wiper 1 is preferably configured to be conical or inclined, as shown in FIG. 1. A cone angle $\alpha$ of 7.50 to 15° relative to the longitudinal wiper axis L is particularly useful.

As can be seen, the retaining portion 2 transitions into preferably at least two first stem portions 4, which protrude from it like unilaterally connected cantilever beams in the direction substantially parallel to the longitudinal wiper axis L.

Each of the stem portions 4 preferably has a width extending over at least 10%, better over at least 15% of the circumference of the retaining portion 2, where the latter transitions into the stem portions 4. As can best be seen In FIG. 2, each stem portion 4 tapers in the circumferential direction from its point of connection to the retaining portion 2 towards its ring portion 5. However, the tapering is preferably configured only sparingly and ideally is less than 20%, better less than 15%, from the proximal end connected to the retaining portion 2 of a wiper arm 3 towards the distal end of the wiper arm 3, because only in this manner can it be avoided that the proximal area of the stem portion becomes too rigid and/or the distal area too yielding, i.e. that the required uniformity of the bending elasticity is not provided. Preferably, each of the stem portions 4 is slightly curved, most frequently in such a way that the outer face of the stem portion 4 facing away from the longitudinal wiper axis L is convexly curved in the circumferential direction, and, if necessary, the inner face of the stem portion facing towards the longitudinal wiper axis L is also concavely curved in the circumferential direction. Preferably, the stem portions are not twisted relative to the longitudinal wiper axis L, in the sense that they wind around the longitudinal wiper axis L like a helical line.

Each stem portion 4 respectively transitions into a ring portion 5 at its distal end.

The entirety of the ring portions 5—which in this first exemplary embodiment are situated in a common plane oriented orthogonally to the longitudinal wiper axis L—forms the actual wiper lip, i.e. the area of the wiper 1 that brings about the predominant part of the intended action of the wiper 1 and which, when the respectively associated cosmetics applicator is pulled out through the wiper 1, strips off excess cosmetic and most frequently returns it into the associated cosmetics storage container.

Figure 2:
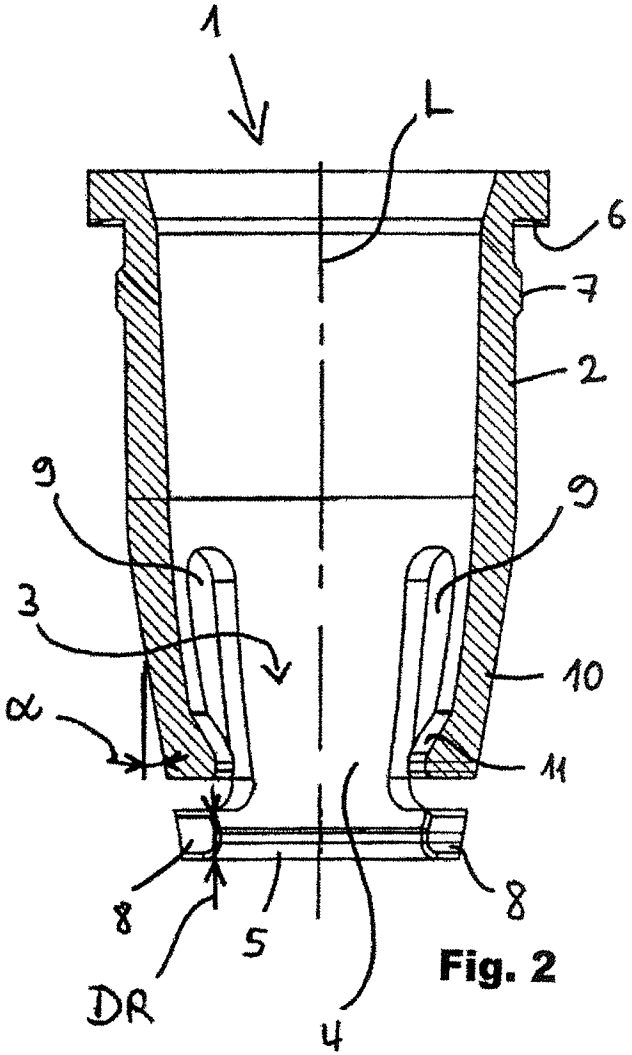
FIG. 2 shows the wiper according to FIG. 1 in a central longitudinal section.

As can best be seen in FIG. 2, the extent of each ring portion 5, viewed in the circumferential direction, is greater than the extent of the stem portion 4 carrying the corresponding ring portion 5, also viewed in the circumferential direction. Because the ring portion 5, in each case on both sides of the stem portion 4 associated with it, forms a ring arm 8 which is connected to the central part of the ring portion 5 only unilaterally and protrudes in the circumferential direction towards both sides over the stem portion 4, like a cantilevered beam attached only unilaterally. Preferably, "is greater than" in this case means more than an only inconsiderable amount. Rather, the two ring arms 8 together constitute at least 35%, and better at least 50%, of the length of the entire ring portion 5, viewed in the circumferential direction. They protrude over the stem portion 4 to the corresponding extent. Generally, the free ends of the ring arms 8 are each situated outside the base area of their or all other stem portions 4—given a projection in the direction along the outer face of the stem portion(s) 4. Even where the latter does not apply, the ring arms 8 in any case project into the gap formed between two stem members 4—viewed in a projection along the longitudinal axis L.

The combination of the stem portion 4 and the ring portion 5 is most frequently configured such that it corresponds in its shape to a forearm support of a crutch that extends upwards away from the grip.

Preferably, each of the stem portions 4 is designed and dimensioned in such a way that it is capable of being deformed to a more than just inconsiderable extent. Ideally, the distal end of each stem portion 4 is capable, where the transition into the ring portion 5 takes place, of being displaced outwards in the radial direction in an elastically reversible manner, under the forces arising as intended during wiping off a cosmetics applicator, by more than 0.8 mm, and better by more than 1.2 mm. Thus, the result is a particularly yielding wiper lip which, however, is still able to nestle up against the covering of the cosmetics applicator, due to the configuration of the individual parts of the wiper lip as a ring portion 5. In the preferred exemplary embodiment shown here, two wiper arms 3 with one ring portion 5 each are provided. Together, these two ring portions 5 form an almost complete circle, that is, they cover preferably at least 320° of a full circle, with a coverage of at least 340°, and possibly more, being extremely desirable.

It can be clearly seen that the ring arms 8 and the rest of the associated ring portion 5 form a common plane distal end face.

Ideally, the ring arms 8 and the rest of the ring portion 5 and preferably also the outer face of the stem portions 4 have an identical curvature in the circumferential direction.

It must also be noted that the ring arms 8 are configured to be very narrow also in the direction parallel to the longitudinal wiper axis L. Their maximum extent DR in this direction is preferably 3.5 mm, better only 2.5 mm.

Since the wiper 1 is generally formed from an elastic plastic, the ring arms 8 therefore are capable of being displaced outwards in the radial direction to a more than inconsiderable extent relative to the stem portion 4 under the load usually arising as intended when a cosmetics applicator is wiped off. A more than just inconsiderable displacement in this case is understood to mean the displacement that is inherently inevitable due to the intrinsic elasticity in every body.

A more than just inconsiderable displacement is therefore understood to mean a displacement of at least 0.8 mm.

It can also be easily seen in FIG. 1 that a window 9 that connects the interior, which is otherwise enclosed by the wiper 1 in the circumferential direction, with the space on the circumferential outer face, is enclosed by two adjacent ring portions 5, the associated stem portions 4 and the retaining portion 2. Such a window precludes the otherwise dreaded "blob effect".

Preferably, a projection 10, which is connected on its one side to the retaining portion 2 and projects therefrom like a cantilever beam, protrudes into this window 9. In this case, the extent of each projection 10, seen in the circumferential direction, is most frequently smaller than the extent of each stem portion 4. Preferably, the respective projection 10 has a constant or at least substantially constant width (+/−7.5%) in the circumferential direction along its entire extent in the direction of the longitudinal wiper axis L.

The configuration of each of the projections 10 contributes to all of them being configured flexibly and preferably able to be displaced in the radially outward direction in a reversibly-flexible manner to a more than inconsiderable extent under the influence of the forces arising as intended during the application. In any case, "more than just inconsiderable" means a displacement of the free distal end of a projection 10 by at least 0.7 mm, better yet by at least 1 mm.

In this case, a projection 10 in each case far from completely covers the surface of a window 9, which as such is free. As can easily be seen in FIG. 1, at least 45%, better still at least 55% of the imaginary window surface area actually remain free.

In any case, the protection 10 or the projections 10 has/have the task of acting as an "auxiliary wiper" for the applicator stem of a cosmetics applicator by wiping the narrow area of the applicator stem that otherwise passes the gap between immediately adjacent ring arms 8 without being wiped off, i.e. being freed from the cosmetic adhering to it (see FIG. 1 that illustrates this). The projection 10 or the projections 10 thus ensure(s) that the entire circumference of an applicator stem cooperating with it is wiped off.

Optionally, the projection 10 or the projections 10—if designed accordingly—can be given the function of providing for a lateral guidance of the applicator covering, in particular during the reinsertion of the cosmetics applicator, so that the covering is able to again pass the ring portions 5 and in particular their ring arms 8 without being bent all too sharply or even get caught in the freely cantilevered ring arms 8 in an unfavorable manner. According to the invention, means (in this case in the form of the projections 10) are provided that cause a stem coverage of at least, and better more, than 360°, so that the stem of a cosmetics applicator cooperating with it is wiped clean all over.

Viewed in the direction of the longitudinal axis L and in a direction towards the proximal end of the wiper 1, a projection 10 ends above the ring portions 5, as can be seen, in particular, from FIG. 1. Preferably, the ring portions 5 of the stem portions 4 reach across the respectively adjacent projection(s) 10, viewed in the circumferential direction, without touching the respective projection(s) 10, which promotes the above-mentioned effect. As can easily be seen from the comparison of FIG. 1 and FIG. 2, the wiper 1 according to the invention preferably has two such projections 10, and thus generally also two windows 9.

Taking a very close look, it is possible to see in FIG. 1, and as FIG. 2 also shows, that preferably each projection 10 carries on its distal end a lip 11 protruding inwards in the radial direction, which preferably contributes to the wiping result.

FIGS. 6 to 10 show a second exemplary embodiment of the invention.

This wiper 1 is also constructed from two portions, one of which is the retaining portion 2 already described in detail above—in this respect, the first and second exemplary embodiments are identical.

The second portion, whose length is marked by the distal end of the longest wiper arm 3, is of equal or substantially equal length as the retaining portion 2 also in this case.

However, the second portion is in this case formed by at least three, and preferably only three, first wiper arms 3.

For every individual one of these wiper arms 3 as such and its components as such, the statements above pertaining to the wiper arms 3 apply. In particular, however, each wiper arm 3 consists of a stem portion 4 and a ring portion 5 comprising two ring arms 8, which protrude in the circumferential direction over the respective stem portion 4 like unilaterally connected cantilevered beams. Preferably, the lengths of the ring portions 5 in the circumferential direction are the same also in this exemplary embodiment.

The wiper arms 3 of this exemplary embodiment, however, differ from those of the first exemplary embodiment in that they all have a different length in the direction of the longitudinal wiper axis L. Thus, the ring portions 5 of the wiper arms 3 form a kind of staircase. Proceeding in a direction from the lowermost ring portion 5 in the circumferential direction, then the next ring member 5 that can be found immediately adjacent is in each case positioned a bit above the preceding ring member 5, until the longest wiper arm 3 has been reached, to which the shortest wiper arm 3 is then directly adjacent, proceeding in the same circumferential direction.

Directly adjacent ring members 5 preferably overlap, most frequently without touching each other. This means that ring arms 8 of two directly adjacent wiper arms 3 lie on top of each other, at least partially, along the longitudinal wiper axis L.

Preferably, a narrow gap, which ideally increases in size in the vicinity of the retaining portion 2, where only the two stem portions 4 are directly adjacent, remains free between every ring arm 8 of a wiper arm 3 and the stem portion 4 of the directly adjacent longer wiper arm 3. Preferably, a window 9 therefore preferably remains free between two directly adjacent wiper arms 3, whose shape can preferably be described as the "shape of the digit 6" and/or the "shape of a mirror-inverted digit 6".

As can be seen rather well, the longest and the shortest stem portions 4 differ in their lengths in the direction parallel to the longitudinal wiper axis L by about 50%, preferably by 50%+/−5%.

Deviating from the first exemplary embodiment, this second exemplary embodiment can be configured in such a way that the flexibility of the stem portions 4 described above for the first exemplary embodiment, i.e. their capacity for being displaced radially outward in an elastically reversible manner to a more than just inconsiderable extent, is provided only for the longest or for the longest and the second longest stem portion 4.

The wiper 1 can be produced by means of injection molding or, alternatively, by 3D printing, i.e. by means of the methods that were developed for rapid prototyping.

The invention claimed is:

1. A wiper for wiping off a cosmetics applicator associated with it, the wiper comprising:

a retaining portion that affixes the wiper to a cosmetics storage container; and at least two wiper arms that are disposed thereon and exert a wiping action on the associated cosmetics applicator, wherein each of the at least two wiper arms is disposed on the retaining portion in an elastically movable manner and has a stem portion and a ring portion, which forms a wiper lip or a part thereof, wherein an extent of the ring portion in a circumferential direction is greater than an extent of the stem portion in the circumferential direction; and wherein the ring portion, in each case on both sides of the stem portion associated with it, forms a ring arm completely curved in the circumferential direction which is connected to the central part of the ring portion only unilaterally and protrudes in the circumferential direction towards both sides over the stem portion, like a cantilevered beam attached only unilaterally.

2. The wiper according to claim 1, wherein a distal end of each stem portion is capable, where a transition into a respective ring portion takes place, of being displaced outwards in an elastically reversible manner in a radial direction, under forces arising as intended when a cosmetics applicator is wiped off, by more than 0.8 mm.

3. The wiper according to claim 1, wherein the stem portion is concavely curved on its inner face facing towards a longitudinal wiper axis and convexly curved on its outer face facing away from the longitudinal wiper axis, in each case viewed in the circumferential direction.

4. The wiper according to claim 1, wherein the ring portion of each of the at least two wiper arms, viewed in the circumferential direction, protrudes on both sides over a molded-on stem portion and thus forms ring arms which protrude on both sides over the stem portion.

5. The wiper according to claim 4, wherein together, the two ring arms constitute at least 35% of a length of the ring portion, viewed in the circumferential direction.

6. The wiper according to the claim 5, wherein the ring arms are so elastic that they are able to be resilient in a radially outward direction relative to the stem portion.

7. The wiper according to claim 1, wherein the ring portions of two diametrically opposing wiper arms form the entire wiper lip.

8. The wiper according to claim 1, wherein the ring portions form a circular ring in the circumferential direction that is substantially closed in itself.

9. The wiper according to claim 1, wherein a window is enclosed by two adjacent ring portions, the associated stem portions and the retaining portion.

10. The wiper according to claim 9, wherein a projection, which is connected on one side to the retaining portion and projects therefrom like a cantilever beam, protrudes into the window.

11. The wiper according to claim 10, wherein the projection ends, viewed in a direction of the longitudinal wiper axis, below the ring portions which, viewed in the circumferential direction, reach across the projection without touching the projection.

12. A wiper for wiping off a cosmetics applicator associated with it, the viper comprising:

a retaining portion for fixing the wiper to a cosmetics storage container; and at least two wiper arms that are disposed thereon and exert a wiping action on the associated cosmetics applicator, wherein each of the at least two wiper arms is disposed on the retaining portion in an elastically movable manner and has a stem portion and a ring portion, which forms a wiper lip or a part thereof, wherein an extent of the ring portion in a circumferential direction is greater than an extent of the stem portion in the circumferential direction;

wherein a window is enclosed by two adjacent ring portions, the associated stem portions, and the retaining portion;

wherein a projection, which is connected on one side to the retaining portion and projects therefrom like a cantilever beam, protrudes into the window; and wherein the projection only covers a maximum of 55% of a surface area of the window.

13. The wiper according to claim 1, wherein the wiper has at least three wiper arms whose stem portions all have different lengths in a direction of a longitudinal wiper axis, so that the ring portions of the wiper arms, viewed in the direction of the longitudinal wiper axis, are held at different distances from the retaining portion.

14. The wiper according to claim 13, wherein directly adjacent ring arms associated with different stem portions overlap in the direction of the longitudinal wiper axis without touching each other.

15. The wiper according to claim 14, wherein a gap, which increases in size in a vicinity of the retaining portion, where only the two stem portions are directly adjacent, remains free between every ring arm of a wiper arm and the stem portion of a directly adjacent longer wiper arm, and wherein a window remains free between two directly adjacent wiper arms, which is configured in a shape of a digit 6 and/or of a mirror-inverted digit 6.

16. The wiper according to claim 1, wherein the wiper is produced by injection molding or by a 3D printing method.

17. A cosmetics unit with a cosmetics storage container, an applicator, a closure cap and a wiper, which is mounted in a neck or a removal opening of the cosmetics storage container, for wiping off cosmetic mass from the wiper, the wiper being configured in accordance with claim 1.

* * * * *